US008114826B1

(12) United States Patent
Hermanson et al.

(10) Patent No.: US 8,114,826 B1
(45) Date of Patent: Feb. 14, 2012

(54) CONCENTRATED SOAP BASED CLEANSING COMPOSITIONS

(75) Inventors: Kevin David Hermanson, Hamden, CT (US); Martin Swanson Vethamuthu, Southbury, CT (US); Anat Shiloach, Trumbull, CT (US); Rajendra Mohanlal Dave, Newark, NJ (US)

(73) Assignee: Conopco, Inc., Englewood Cliffs, NJ (US)

( * ) Notice: Subject to any disclaimer, the term of this patent is extended or adjusted under 35 U.S.C. 154(b) by 0 days.

(21) Appl. No.: 13/046,985

(22) Filed: Mar. 14, 2011

Related U.S. Application Data

(60) Provisional application No. 61/440,415, filed on Feb. 8, 2011.

(51) Int. Cl.
*C11D 17/00* (2006.01)

(52) U.S. Cl. ..... 510/353; 510/355; 510/389; 510/399; 510/426; 510/430; 510/432; 510/481; 510/490; 510/505

(58) Field of Classification Search ..... None
See application file for complete search history.

(56) References Cited

U.S. PATENT DOCUMENTS

| | | | | |
|---|---|---|---|---|
| 4,493,786 | A | 1/1985 | Joshi | |
| 5,308,526 | A | 5/1994 | Dias | |
| 5,753,600 | A * | 5/1998 | Kamegai et al. | 510/131 |
| 6,391,835 | B1 | 5/2002 | Gott et al. | |
| 6,503,517 | B1 | 1/2003 | Mohammadi et al. | |
| 7,884,060 | B1 | 2/2011 | Hermanson et al. | |
| 7,884,061 | B1 | 2/2011 | Hermanson et al. | |
| 2001/0056049 | A1 | 12/2001 | Aronson | |
| 2002/0128163 | A1 | 9/2002 | Lambino et al. | |
| 2006/0265344 | A1 | 11/2006 | Woods | |
| 2007/0021316 | A1 | 1/2007 | Dilley et al. | |
| 2007/0275022 | A1 | 11/2007 | Satou et al. | |
| 2008/0095807 | A1 | 4/2008 | Zabari | |
| 2009/0264330 | A1 | 10/2009 | Bruckner et al. | |
| 2010/0179084 | A1 | 7/2010 | Tao et al. | |

* cited by examiner

*Primary Examiner* — Necholus Ogden, Jr.
(74) *Attorney, Agent, or Firm* — Milton L. Honig

(57) ABSTRACT

A flowable concentrated soap cleansing composition is provided which includes from 40 to 65% of $C_{12}$-$C_{18}$ fatty acid mixture in combined amount of salt and free acid forms, the mixture having $C_{12}$-$C_{14}$ chain length present in greater amount than $C_{16}$-$C_{18}$ chain length of fatty acid. Further, the composition includes 25 to 50% water, 1 to 15% of a first anti-crystallization agent, and 2 to 15% of a second anti-crystallization agent. The first anti-crystallization agent is sodium lauryl ether sulfate with a weight average ethoxylation of from 0.5 to 2 moles ethylene oxide per mole of sulfate. The second anti-crystallization agent is polypropylene glycol of weight average molecular weight ranging from 195 to 10,000. The composition has a viscosity ranging from 10 to 100 Pa*s at 20° C. as measured after 2 minutes at 10 rpm on a Brookfield Viscometer using Spindle RV 7.

10 Claims, No Drawings

CONCENTRATED SOAP BASED CLEANSING COMPOSITIONS

BACKGROUND OF THE INVENTION

1. Field of the Invention

The invention concerns flowable cleanser compositions formulated with high levels of fatty acid salt (soap).

2. The Related Art

Modern products need to be more environmentally friendly. They must be engineered to have lower energy consumption, utilize sustainable resources (i.e. avoid fossil fuels) and conserve water resources. In personal cleansing products, this means rethinking toilet bar and liquid hand and body wash formulations. Toilet bars have the beneficial aspect of delivering surfactant as a concentrate; they usually contain more than 50% surfactant. Unfortunately, bars are slow to lather. Considerable running water is wasted to initiate lather. A second disadvantage is the impossibility for a consumer to measure out a precise dose of cleansing composition from a bar format. Too much material is consequently washed down the drain.

These disadvantages are overcome through use of liquid hand wash and body wash (shower gel) products. These can be accurately dosed and they lather relatively more quickly. Unfortunately, this format requires incorporation of relatively high amounts of water within the formulations. This results in necessity for larger packaging, a significant portion of which is merely to transport sometimes 50% or more water. There are also incremental wastes of energy in transporting a largely water based system.

Environmental and sustainability problems with personal cleansers can be overcome through use of flowable low water content concentrates. These contain relatively high levels of surfactant but utilize only enough water to allow quick initial lathering and controlled dosing.

Soaps are fatty acid salts. The fatty acids are sustainably sourceable from palm oil and other vegetative raw materials. In our work formulating high levels of soap, the present inventors have obtained resultant concentrates prone to partial crystallization of the soap. Even small amounts of crystallization resulted in visually displeasing products. Ordinarily clear compositions turned turbid. Also there were problems with maintaining an even viscosity. Accordingly, soap based concentrates were sought that have good stability against crystallization.

SUMMARY OF THE INVENTION

A flowable concentrated soap cleansing composition is provided which includes:

(i) from about 40 to about 65% by weight of $C_{12}$-$C_{18}$ fatty acid mixture in combined amount of salt and free acid form, the mixture having $C_{12}$-$C_{14}$ chain length present in greater amount than $C_{16}$-$C_{18}$ chain length of fatty acid;

(ii) from about 25 to about 50% by weight of water;

(iii) from about 1 to about 15% of a first anti-crystallization agent which is sodium lauryl ether sulfate with an average ethoxylation of from 0.5 to 2 moles ethylene oxide per mole of sulfate;

(iv) from about 2 to about 15% by weight of a second anti-crystallization agent which is polypropylene glycol having a weight average molecular weight ranging from about 195 to about 10,000; and wherein the composition has a viscosity ranging from about 10 to about 100 Pa*s at 20° C. as measured after 2 minutes at 10 rpm on a Brookfield Viscometer using Spindle RV 7.

DETAILED DESCRIPTION OF THE INVENTION

Now it has been found that certain materials can inhibit crystallization of the fatty acid salts. The compositions also require the fatty acid mixture of salt and free fatty acid to mainly be $C_{12}$-$C_{14}$ and have a much smaller amount of $C_{16}$-$C_{18}$ chain length.

Accordingly, the compositions may contain a first anti-crystallization agent which is sodium lauryl ether sulfate. Most effective is a variant with an average ethoxylation of from 0.5 to 2 moles ethylene oxide per one mole of sulfate. The most preferred ratio has an average ethoxylation of about one mole ethylene oxide per one mole of sulfate. This agent is often described as SLES-1EO. Amounts of the sodium lauryl ether sulfate may range from about 2 to about 15%, preferably from about 4 to about 12%, and optimally from about 5 to about 10% by weight.

A second anti-crystallization agent useful with compositions herein is polypropylene glycol. These polymers may have a weight average molecular weight ranging from about 195 to about 10,000, preferably from about 300 to about 5,000, and optimally from about 450 to about 3,600 weight average molecular weight. Preferred is PPG-9 sold commercially by Dow Chemical Corp. as Polyglycol P-425. Amounts of the polypropylene glycol may range from about 1 to about 15%, preferably from about 5 to about 12%, and optimally from about 7 to about 10% by weight of the composition.

Fatty acid whether in free acid or salt forms will be present in combined amounts ranging between about 40% and about 65%, preferably from about 45% to about 60%, and optimally between 50% and 55% by weight of the composition. By selecting a majority of the fatty acid from chain length $C_{12}$-$C_{14}$ and maintaining only a small amount of $C_{16}$-$C_{18}$ chain length, crystallization can be minimized. In particular, the amount of $C_{12}$-$C_{14}$ fatty acid (free acid plus salt) relative to $C_{16}$-$C_{18}$ fatty acid (free acid plus salt) may exist in a weight ratio from about 8:1 to about 2:1, preferably from about 6:1 to about 4:1, optimally about 5:1 by weight.

Amounts of the $C_{12}$-$C_{14}$ fatty acid (free acid plus salt) relative to $C_{16}$ fatty acid (free acid plus salt) may be present in a relative weight ratio from about 30:1 to about 2:1, preferably from about 20:1 to about 6:1, and optimally from about 20:1 to about 10:1 by weight.

Amounts of $C_{12}$ relative to $C_{14}$ fatty acid in salt and free acid form may be present from about 0.4:1 to about 1.4:1, preferably from about 0.8:1 to about 1.1:1 by weight.

Advantageously, the fatty acid mixture is present in only partially neutralized form. In particular, there is advantage in neutralization from 93% to 96.5%, preferably from 94% to 96.5%, and optimally between 94.5 and 96% neutralization of the fatty acid mixture.

Water may be present in the compositions in an amount from about 25 to about 50%, preferably from about 25 to about 40%, and optimally from about 25 to about 35% by weight.

Advantageously neutralization of the fatty acids primarily may be with potassium alkali rather than sodium or ammonium alkali (e.g. hydroxides). This provides potassium soaps.

Another useful component of compositions of the present invention is that of a betaine. Most useful is cocoamidopropyl betaine. Amounts of the betaine may range from about 0.5 to about 12%, preferably from about 1 to about 8%, and optimally from about 1.5 to about 4% by weight of the composition.

Compositions may contain moisturizers. Illustrative of these materials are petrolatum, mineral oil and vegetable oils. Amongst the vegetable oils which are useful are sunflower seed oil, cottonseed oil, olive oil, safflower oil, canola oil and mixtures thereof. Amounts of the moisturizer may range from about 0.1 to about 30% by weight of the composition.

Deposition aids, sunscreens and skin care compounds may also be included in the compositions. Deposition aids may include such materials as quaternary ammonium salts, particularly cationic guar gums and quaternized cellulosics. These may be available under the trademarks Jaguar C17S and Polymer JR. Typical useful sunscreen agents may include Parsol® MCX (octylmethoxycinnamate) and Parsol® 1789. Skin nutrient compounds that may be useful are niacinamide and the vitamins. Amongst the latter are included Vitamin A (e.g. Vitamin A Palmitate), Vitamin C, Vitamin B and Vitamin D as well as mixtures thereof. Amounts of any of these materials may range from about 0.0001 to about 10% by weight of the composition.

The flowable compositions described herein may have a viscosity ranging from about 10 to about 100 Pascal second (about 10,000 to about 100,000 cps), preferably from about 15 to about 50, optimally from about 20 to about 40 Pa*s. These viscosities are measured at 20° C. on a Brookfield Viscometer after 2 minutes at 10 rpm with Spindle RV 7.

Preservatives can desirably be incorporated into the cleansing compositions to protect against the growth of potentially harmful microorganisms. Particularly preferred preservatives are phenoxyethanol, methyl paraben, propyl paraben, imidazolidinyl urea, dimethyloldimethylhydantoin, ethylenediaminetetraacetic acid salts, methylchloroisothiazolinone, methylisothiazolinone, iodopropynbutylcarbamate and benzyl alcohol. Amounts of these preservatives may range from 0.01 to 2% by weight of the compositions.

Except in the operating and comparative examples, or where otherwise explicitly indicated, all numbers in this description indicating amounts of material ought to be understood as modified by the word "about".

The term "comprising" is meant not to be limiting to any subsequently stated elements but rather to encompass non-specified elements of major or minor functional importance. In other words the listed steps, elements or options need not be exhaustive. Whenever the words "including" or "having" are used, these terms are meant to be equivalent to "comprising" as defined above.

The following examples will more fully illustrate the embodiments of this invention. All parts, percentages and proportions referred to herein and in the appended claims are by weight unless otherwise illustrated.

Example 1

A series of experiments were conducted to evaluate the effect of certain first anti-crystallization agents. The formulas and results are reported in Table I below.

TABLE I

| Component | Sample (Weight %) A | B | C |
|---|---|---|---|
| Lauric Fatty Acid | 17.9 | 17.8 | 17.9 |
| Myristic Fatty Acid | 19.5 | 19.5 | 19.5 |

TABLE I-continued

| Component | Sample (Weight %) A | B | C |
|---|---|---|---|
| Palmitic Fatty Acid | 3.6 | 3.6 | 3.6 |
| Stearic Fatty Acid | 3.6 | 3.6 | 3.6 |
| Potassium Hydroxide (45% Active) | 23.4 | 23.3 | 23.4 |
| Sodium Lauryl Sulfate | 5.7 | 0.0 | 0.0 |
| Sodium Lauryl Ether Sulfate-1EO | 0.0 | 5.7 | 0.0 |
| Sodium Lauryl Ether Sulfate-3EO | 0.0 | 0.0 | 5.7 |
| Cocoamidopropylbetaine | 2.0 | 2.0 | 2.0 |
| Polypropylene Glycol (MW = 425) | 9.3 | 9.4 | 9.3 |
| Water | 14.6 | 14.6 | 14.6 |
| Preservative | 0.4 | 0.4 | 0.4 |
| Crystallization Point (° C.) | 19.7 | 13.8 | 26.0 |

All three samples were evaluated for their effect on crystallization temperature. A Differential Scanning calorimeter was used to evaluate the temperature point at which a sample turned clear with all traces of crystallization removed. The lower the value of the Crystallization Point, the better the sample performance. Table I reveals that sodium lauryl ether sulfate having one mole of ethoxylation (SLES-1EO) performed better than the three mole ethoxylation (SLES-3EO) variant. Compare sample B with sample C. Sodium lauryl sulfate without ethoxylation (sample A) was found to be inferior to sample B utilizing the SLES-1EO) but better than sample C (SLES-3EO).

Example 2

Another series of experiments were conducted to evaluate the effect of a second anti-crystallization agent. This material is polypropylene glycol. Table II lists the formulas of the test samples. Crystallization Point temperatures were taken on a Differential Scanning calorimeter.

TABLE II

| Component | Sample (Weight %) D | E | F | G |
|---|---|---|---|---|
| Lauric Fatty Acid | 17.9 | 17.9 | 17.8 | 17.9 |
| Myristic Fatty Acid | 19.5 | 19.5 | 19.5 | 19.5 |
| Palmitic Fatty Acid | 3.6 | 3.6 | 3.6 | 3.6 |
| Stearic Fatty Acid | 3.6 | 3.6 | 3.6 | 3.6 |
| Potassium Hydroxide (45% Active) | 23.4 | 23.4 | 23.3 | 23.4 |
| Sodium Lauryl Ether Sulfate-1EO | 5.7 | 5.7 | 5.7 | 5.7 |
| Cocoamidopropylbetaine | 2.0 | 2.0 | 2.0 | 2.0 |
| Propylene Glycol (MW = 76) | 9.3 | 0.0 | 0.0 | 0.0 |
| Dipropylene Glycol (MW = 134) | 0.0 | 9.3 | 0.0 | 0.0 |
| Polypropylene Glycol (MW = 425) | 0.0 | 0.0 | 9.4 | 0.0 |
| Polypropylene Glycol (MW = 3552) | 0.0 | 0.0 | 0.0 | 9.3 |
| Water | 14.6 | 14.6 | 14.6 | 14.6 |
| Preservative | 0.4 | 0.4 | 0.4 | 0.4 |
| Crystallization Point (° C.) | 26.3 | 25.3 | 13.8 | 16.1 |

The samples with higher molecular weight polypropylene glycols (those above 134 mw) have Crystallization Points below about room temperature. By contrast, the samples with lower molecular weight glycols such as propylene glycol and dipropylene glycol are less efficient at inhibiting crystallization. These have Crystallization Points above room temperature. It is evident that the higher molecular weight polypropylene glycols contribute to fighting crystallization.

Example 3

Experiments were conducted to evaluate the effect of different $C_{12}$ to $C_{14}$ ratios. The samples were subjected to Differential Scanning calorimetry. The fatty acid chain length distribution is provided in Table III below. The latter Table also reports the Crystallization Point results, lower temperatures being better.

TABLE III

| Component | Sample (Weight %) | | | | | |
|---|---|---|---|---|---|---|
| | H | I | J | K | L | M |
| Lauric Fatty Acid | 18.0 | 19.1 | 22.1 | 23.6 | 25.0 | 27.3 |
| Myristic Fatty Acid | 19.2 | 18.0 | 15.0 | 13.5 | 12.0 | 9.8 |
| Palmitic Fatty Acid | 3.7 | 3.7 | 3.7 | 3.6 | 3.6 | 3.7 |
| Stearic Fatty Acid | 3.7 | 3.7 | 3.7 | 3.6 | 3.6 | 3.7 |
| Potassium Hydroxide (45% Active) | 23.3 | 23.4 | 23.5 | 23.6 | 23.7 | 23.9 |
| Sodium Lauryl Ether Sulfate-1EO | 5.7 | 5.7 | 5.7 | 5.7 | 5.7 | 5.7 |
| Cocoamidopropylbetaine | 2.0 | 2.0 | 2.0 | 2.0 | 2.0 | 2.0 |
| Polypropylene Glycol (MW = 425) | 9.4 | 9.4 | 9.4 | 9.4 | 9.4 | 9.4 |
| Water | 14.7 | 14.6 | 14.5 | 14.4 | 14.4 | 14.1 |
| Preservative | 0.4 | 0.4 | 0.4 | 0.4 | 0.4 | 0.4 |
| Weight % Ratio of C12 to C14 | 0.9 | 1.1 | 1.5 | 1.7 | 2.1 | 2.8 |
| Crystallization Point (° C.) | 14.3 | 13.4 | 21.6 | 21.9 | 22.3 | 22.9 |

The fatty acid profile for the chain length distributions was held constant at 5.08:1 for the ratio of $C_{12}$-$C_{14}$ to $C_{16}$-$C_{18}$. Only the relevant amount of lauric vs. myristic acids was altered. Table III shows that myristic acid is more effective at lowering the crystallization temperature than lauric acid. The Crystallization Point is lowered below room temperature for $C_{12}$ to $C_{14}$ ratios less than 1.5. Compare Example I to Example J.

Example 4

As counterpoint to Example 3, a series of experiments were conducted to evaluate the effect of differing amounts of palmitic vs. stearic acids. The fatty acid chain length distribution is specified in Table IV along with the Crystallization Point results.

TABLE IV

| Component | Sample (Weight %) | | | |
|---|---|---|---|---|
| | N | O | P | Q |
| Lauric Fatty Acid | 17.4 | 17.4 | 17.4 | 17.4 |
| Myristic Fatty Acid | 19.5 | 19.5 | 19.5 | 19.5 |
| Palmitic Fatty Acid | 6.8 | 3.6 | 1.8 | 0.0 |
| Stearic Fatty Acid | 0.4 | 3.6 | 5.5 | 7.3 |
| Potassium Hydroxide (45% Active) | 24.5 | 24.4 | 24.3 | 24.3 |
| Sodium Lauryl Ether Sulfate-1EO | 5.7 | 5.7 | 5.7 | 5.7 |
| Cocoamidopropylbetaine | 2.0 | 2.0 | 2.0 | 2.0 |
| Polypropylene Glycol (MW = 425) | 9.4 | 9.4 | 9.4 | 9.4 |
| Water | 13.8 | 13.9 | 13.9 | 14.0 |
| Preservative | 0.4 | 0.4 | 0.4 | 0.4 |
| Weight % Ratio of $C_{12}$-$C_{14}$ to $C_{16}$ | 5.4 | 10.3 | 20.5 | — |
| Crystallization Point (° C.) | 12.3 | 11.4 | 9.3 | 21.8 |

In Table IV, the ratio of $C_{12}$-$C_{14}$ relative to $C_{16}$-$C_{18}$ was held constant at 5.08:1. The Table shows that a small amount of palmitic acid is useful in lowering the Crystallization Point. Compare Sample P to Sample Q. As the ratio of $C_{12}$-$C_{14}$ to $C_{16}$ increases from about 5:1 to higher than 20:1, the results improve. However, the total absence of palmitic fatty acid abruptly causes an undesirable surge in the Crystallization Point to 21:8.

Example 5

Herein are reported experiments which delineate the effect of low vs. high chain length ratio (i.e. $C_{12}$-$C_{14}$ vs. $C_{16}$-$C_{18}$). See Table V.

TABLE V

| Component | Sample (Weight %) | | |
|---|---|---|---|
| | R | S | T |
| Lauric Fatty Acid | 19.3 | 17.8 | 17.7 |
| Myristic Fatty Acid | 21.6 | 19.5 | 9.9 |
| Palmitic Fatty Acid | 1.8 | 3.6 | 8.6 |
| Stearic Fatty Acid | 1.8 | 3.6 | 8.6 |
| Potassium Hydroxide (45% Active) | 23.7 | 23.3 | 22.7 |
| Sodium Lauryl Ether Sulfate-1EO | 5.7 | 5.7 | 5.7 |
| Cocoamidopropylbetaine | 2.0 | 2.0 | 2.0 |
| Polypropylene Glycol (MW = 425) | 9.4 | 9.4 | 9.4 |
| Water | 14.2 | 14.6 | 15.0 |
| Preservative | 0.4 | 0.4 | 0.4 |
| Weight % Ratio of $C_{12}$-$C_{14}$ to $C_{16}$-$C_{18}$ | 11.2:1 | 5.1:1 | 1.6:1 |
| Crystallization Point (° C.) | 22.2 | 13.8 | 20.7 |

Results from the above experiments indicate that prevention of crystallization is best achieved by having an excess of $C_{12}$-$C_{14}$ over the higher chain length of $C_{16}$-$C_{18}$ fatty acid (and salt). Ratios of these chain lengths that approached 11.2:1 or those as low as 1.6:1 were shown to give poorer results than the 5.1:1 ratio sample. Compare Sample S to R and T.

Example 6

A series of experiments were conducted to evaluate the effect of neutralization. Table VI details the % neutralization and resultant Clarity. Sample F formula was employed for the experiments and treated with different amounts of alkali.

TABLE VI

| Experiment | Sample F Variable Neutralization | | | | | | |
|---|---|---|---|---|---|---|---|
| | 1 | 2 | 3 | 4 | 5 | 6 | 7 |
| % Neutralized | 92.84 | 94.50 | 96.00 | 97.00 | 98.00 | 99.00 | 100.00 |
| Clarity* | Opaque | Mostly clear | Clear | Clear | Opaque | Opaque | Opaque |

* After 1 week at 8° C. storage.

The results show that retaining a small percentage of unneutralized fatty acids improves clarity of the resultant compositions. The best area lies between 94 and 97.5% neutralization. Compare Experiments 2-4 against Experiments 1 and 5.

What is claimed is:

1. A flowable concentrated soap cleansing composition comprising:

(i) from about 40 to about 65% by weight of $C_{12}$-$C_{18}$ fatty acid mixture in combined amount of salt and free acid form, the mixture having $C_{12}$-$C_{14}$ chain length present in greater amount than $C_{16}$-$C_{18}$ chain length of fatty acid;

(ii) from about 25 to about 50% by weight of water;

(iii) from about 1 to about 15% of a first anti-crystallization agent which is sodium lauryl ether sulfate with an average ethoxylation of from 0.5 to 2 moles ethylene oxide per mole of sulfate;

(iv) from about 2 to about 15% by weight of a second anti-crystallization agent which is polypropylene glycol having a weight average molecular weight ranging from about 195 to about 10,000; and wherein the composition has a viscosity ranging from about 10 to about 100 Pa*s at 20° C. as measured after 2 minutes at 10 rpm on a Brookfield Viscometer using Spindle RV 7.

2. The composition according to claim 1 wherein the amount of $C_{12}$-$C_{14}$ relative to $C_{16}$-$C_{18}$ fatty acid in salt and free acid form ranges from about 8:1 to about 2:1.

3. The composition according to claim 2 wherein the amount of $C_{12}$-$C_{14}$ relative to $C_{16}$-$C_{18}$ fatty acid in salt and free acid form ranges from about 6:1 to about 4:1.

4. The composition according to claim 1 wherein the amount of water ranges from about 25 to about 35% by weight.

5. The composition according to claim 1 wherein from 94 to 97.5% of the fatty acid mixture is present in salt form and a remainder in free acid form.

6. The composition according to claim 1 wherein the polypropylene glycol has a weight average molecular weight ranging from about 450 to about 3,600.

7. The composition according to claim 1 further comprising from about 0.5 to about 12% by weight of cocoamidopropyl betaine.

8. The composition according to claim 1 wherein the amount of $C_{12}$-$C_{14}$ relative to $C_{16}$ fatty acid in salt and free acid form ranges from about 30:1 to about 2:1.

9. The composition according to claim 1 wherein the amount of $C_{12}$ to $C_{14}$ fatty acid in salt and free acid form ranges from about 0.4:1 to about 1.4:1 by weight.

10. The composition according to claim 1 wherein the amount of $C_{12}$ to $C_{14}$ fatty acid in salt and free acid form ranges from 0.8:1 to 1.1:1 by weight.

* * * * *